US006119450A

United States Patent [19]

Boegner et al.

[11] Patent Number: 6,119,450

[45] Date of Patent: Sep. 19, 2000

[54] PROCESS AND SYSTEM FOR PURIFYING EXHAUST GASES OF AN INTERNAL-COMBUSTION ENGINE

[75] Inventors: Walter Boegner, Remseck; Guenter Karl, Esslingen; Bernd Krutzsch, Denkendorf; Christof Schoen, Remshalden; Dirk Voigtlaender, Korntal; Guenter Wenninger, Stuttgart, all of Germany

[73] Assignee: DaimlerChrysler AG, Stuttgart, Germany

[21] Appl. No.: 09/236,089

[22] Filed: Jan. 25, 1999

[30] Foreign Application Priority Data

Jan. 24, 1998 [DE] Germany ..... 198 02 631

[51] Int. Cl.[7] ..... F01N 3/00

[52] U.S. Cl. ..... 60/274; 60/276; 60/277

[58] Field of Search ..... 60/274, 276, 277, 60/285, 304

[56] References Cited

U.S. PATENT DOCUMENTS 5,657,625 8/1997 Koga et al. .

FOREIGN PATENT DOCUMENTS 0582 917 2/1994 European Pat. Off. .
0625 633 11/1994 European Pat. Off. .
0814 242 12/1997 European Pat. Off. .
129236 5/1994 Japan .
332071 12/1995 Japan .
2605 580 2/1997 Japan .

*Primary Examiner*—Teresa Walberg
*Assistant Examiner*—Shawntina T. Fuqua
*Attorney, Agent, or Firm*—Evenson, McKeown, Edwards & Lenahan, P.L.L.C.

[57] ABSTRACT

An internal-combustion engine includes an engine control system that permits a change-over between a lean operation and a rich operation of the internal-combustion engine, and an exhaust gas purification system. A λ-probe, an $SO_x$ storage catalyst and an $NO_x$ storage catalyst are successively arranged in an exhaust gas line behind the engine. At the start of desulfurization of the $SO_x$ storage catalyst, a change-over takes place from the lean to the rich operation of the engine. Secondary air is fed into the exhaust gas line; a predetermined λ value of the exhaust gases mixed with secondary air and a temperature in the $SO_x$ storage catalyst are measured. At the end of the desulfurization, a change-over takes place from the rich to a lean operation of the engine.

19 Claims, 3 Drawing Sheets

PROCESS AND SYSTEM FOR PURIFYING EXHAUST GASES OF AN INTERNAL-COMBUSTION ENGINE

BACKGROUND AND SUMMARY OF THE INVENTION

This application claims the priority of German Patent Application No. 198 02 631.5, filed Jan. 24, 1998, the disclosure of which is expressly incorporated by reference herein.

The present invention relates to a process for purifying exhaust gases of an internal-combustion engine. In addition, the invention relates to a system for purifying exhaust gases of an internal-combustion engine.

In order to reduce the pollutant emissions of an internal-combustion engine (for example, a diesel or Otto engine), such an engine can be equipped with an emission control system through which the exhaust gases flow. For purifying the internal-combustion engine exhaust gases, $NO_x$-adsorber systems are particularly suitable. Under certain conditions, such exhaust gas purification elements, which are also called $NO_x$ adsorber catalysts, store the nitrogen oxides ($NO_x$) of internal-combustion engines when they are operated in a "lean" manner. Such a lean operation exists if the combustion air ratio lambda ($\lambda$) is larger than 1 (i.e., when there is an overstoichiometric combustion, during which large amounts of oxygen are present in the exhaust gas). For the regeneration of such $NO_x$ adsorber systems which, because of their storage capability are also called storage catalysts, an exhaust gas is required that has a reducing effect and a reducing agent content that is as high as possible. This results in the $NO_x$ stored in the $NO_x$ adsorber catalyst being released and converted to nitrogen $N_2$. An internal-combustion engine produces exhaust gas that has a reducing effect when a "rich" combustion is present (that is, an understoichiometric combustion with $\lambda<1$), during which no residual oxygen or only little residual oxygen exists in the exhaust gas.

The internal-combustion engines equipped with such an $NO_x$ storage catalyst must therefore have an engine control system that permits a change between a lean operation and a rich operation of the internal-combustion engine.

During the lean operation, the exhaust gases of the internal-combustion engine contain sulfur oxide compounds ($SO_x$), preferably sulfur dioxide ($SO_2$), which react with the storage material of the $NO_x$ storage catalyst and in the process form sulfates. Such sulfate formation leads to a reduction of the $NO_x$ storage capacity of the $NO_x$ storage catalyst. This is also called "sulfur poisoning" of the $NO_x$ storage catalyst.

So that an exhaust gas purification system with an $NO_x$ storage catalyst can function properly over an extended time period, the sulfur content in the exhaust gas must be reduced. The essential sulfur sources are the fuel and the engine oil. Thus, fuels and engine oils with a lower sulfur content increase the useful life of the $NO_x$ storage catalyst.

The sulfate formation in the $NO_x$ storage catalyst can also be avoided if an $SO_x$ storage catalyst (also called an $SO_x$ trap) is arranged in the exhaust gas line in front of the $NO_x$ storage catalyst. When the exhaust gases flow through the $SO_x$ storage catalyst, a large portion of the sulfur compounds emitted by the engine are adsorbed and stored therein. In this manner, the durability of the $NO_x$ storage catalyst is considerably improved.

However, the $SO_x$ storage capacity of such an $SO_x$ trap or $SO_x$ storage catalyst is limited so that regeneration or desulfurization of the $SO_x$ storage catalyst must be carried out for a continuous operation. Such a desulfurization can be achieved by means of an exhaust gas which contains a reducing agent (such as CO, $H_2$, HC) and has a relatively high temperature. Under these conditions, the previously stored sulfur quantities are mainly desorbed as $SO_2$ and $H_2S$ and released, in which case the $SO_x$ storage capacity of the $SO_x$ storage catalyst is restored.

The present invention has the object of further developing a process of the initially mentioned type such that the exhaust gas composition and exhaust temperature required for the desulfurization of the $SO_x$ storage catalyst can be provided by technically simple measures and devices.

This object is achieved by means of a process according to the present invention.

The present invention is based on the general idea of varying the exhaust gas composition by means of the engine control such that it has a reducing atmosphere which, for the $SO_x$ storage catalyst, causes a release of the $SO_x$ compounds. The high exhaust gas temperature also required for this purpose is reached in a simple manner by means of feeding secondary air into the exhaust gas line, behind the engine and in front of the $SO_x$ storage catalyst. Here, the exhaust gas enriched by reducing agents contains a high chemical energy which, while oxygen is fed, can be converted to thermal energy by means of corresponding chemical reactions. The oxygen required for this purpose is made available with the secondary air. In the $SO_x$ storage catalyst, a portion of the reducing agents carried along in the exhaust gas catalytically combusts with the oxygen of the secondary air, during which the thermal energy is released and is preferably transmitted to the surface material of the $SO_x$ storage catalyst. The high temperature in the $SO_x$ storage catalyst required for the sulfate decomposition can therefore be generated by this chemical reaction in the $SO_x$ storage catalyst itself and therefore requires no additional energy source.

An atmosphere containing reducing agent is provided in the exhaust gas in a simple manner. As the result of the engine control, a change is made from the lean operation to a rich operation of the internal-combustion engine.

In order to be able to obtain an optimal desulfurization, preferably a temperature or more than 550° C. is set in the $SO_x$ storage catalyst.

In order to be able to achieve such a high temperature in the $SO_x$ storage catalyst and in order to achieve a composition of the exhaust gases which is optimal for the desulfurization of the $SO_x$ storage catalyst, the combustion air ratio of the exhaust gases mixed with the secondary air is selected from a range of $\lambda=0.75$ to $\lambda=0.99$.

The setting of these preferred values for the combustion air ratio of the exhaust gases mixed with secondary air and for the temperature existing in the $SO_x$ storage catalyst corresponding to a preferred embodiment of the present invention is achieved in that, during the desulfurization, the engine control influences or varies the quantity of the fed secondary air and/or the combustion air ratio of the exhaust gases coming from the engine. This permits in a simple manner an automatic control or control of the parameters which are characteristic of desulfurization.

In the case of an exhaust gas purification system, in which the $SO_x$ storage catalyst is arranged in the exhaust gas line in front of the $NO_x$ storage catalyst, the sulfur compounds released during the desulfurization of the $SO_x$ storage catalyst arrive in the $NO_x$ storage catalyst and can form compounds there with the $NO_x$ storage material and form sulfates. This has the result that the $NO_x$ storage capacity of the $NO_x$ storage catalyst is reduced.

The problem therefore occurs of carrying out the desulfurization of the $SO_x$ storage catalyst such that in the process the storage capacity of the $NO_x$ storage catalyst is not impaired. This is achieved in that a bypass is provided in the exhaust gas line which bypasses the $NO_x$ storage catalyst and which is activated during the desulfurization by the engine control. By means of this bypass, the exhaust gases loaded with the sulfur compounds are directed away from the $NO_x$ storage catalyst during the desulfurization so that no sulfate formation can occur in the $NO_x$ storage catalyst.

In another, particularly advantageous embodiment of the process according to the present invention, the adsorption of sulfur compounds in the $NO_x$ storage catalyst during the desulfurization of the $SO_x$ storage catalyst can be prevented in that, after the change-over from the lean operation to the rich operation of the internal-combustion engine, a regeneration of the $NO_x$ storage catalyst is carried out. The engine control monitors a parameter which correlates to the degree of regeneration of the $NO_x$ storage catalyst, and only when a predetermined threshold value for this parameter is reached, secondary air is fed into the exhaust gas line. By means of this preceding regeneration phase, with the aid of the reducing agents emitted by the engine during the rich operation, the oxygen quantities and nitrates stored in the $SO_x$ storage catalyst and in the $NO_x$ storage catalyst are converted. As the result, the two catalysts ($SO_x$ and $NO_x$ storage catalyst) are changed to a reduced condition, in which, except for the sulfates in the $SO_x$ storage catalyst, approximately no more oxygen-containing atoms or molecules exist in the catalysts. After such a regeneration, particularly of the $NO_x$ storage catalyst, the actual desulfurization of the $SO_x$ storage catalyst can then take place in that secondary air is fed. In the case of an immediately following desulfurization, the sulfur compounds adsorbed and stored during the lean operation are desorbed and released from the $SO_x$ storage catalyst. The released sulfur compounds can flow through the reduced $NO_x$ storage catalyst without the possibility that an adsorption or storage of the sulfur compounds can take place. Sulfur poisoning or sulfurization of the $NO_x$ storage catalyst can therefore be prevented during the desulfurization of the $SO_x$ storage catalyst connected in front, specifically exclusively by the selection of a particularly skillful course of the control and automatic control operations. An exhaust purification system operating according to this process has few movable components and is therefore robust, not very susceptible to disturbances and reasonable in price.

Other objects, advantages and novel features of the present invention will become apparent from the following detailed description of the invention when considered in conjunction with the accompanying drawings.

DETAILED DESCRIPTION OF THE DRAWINGS

Figure 1:
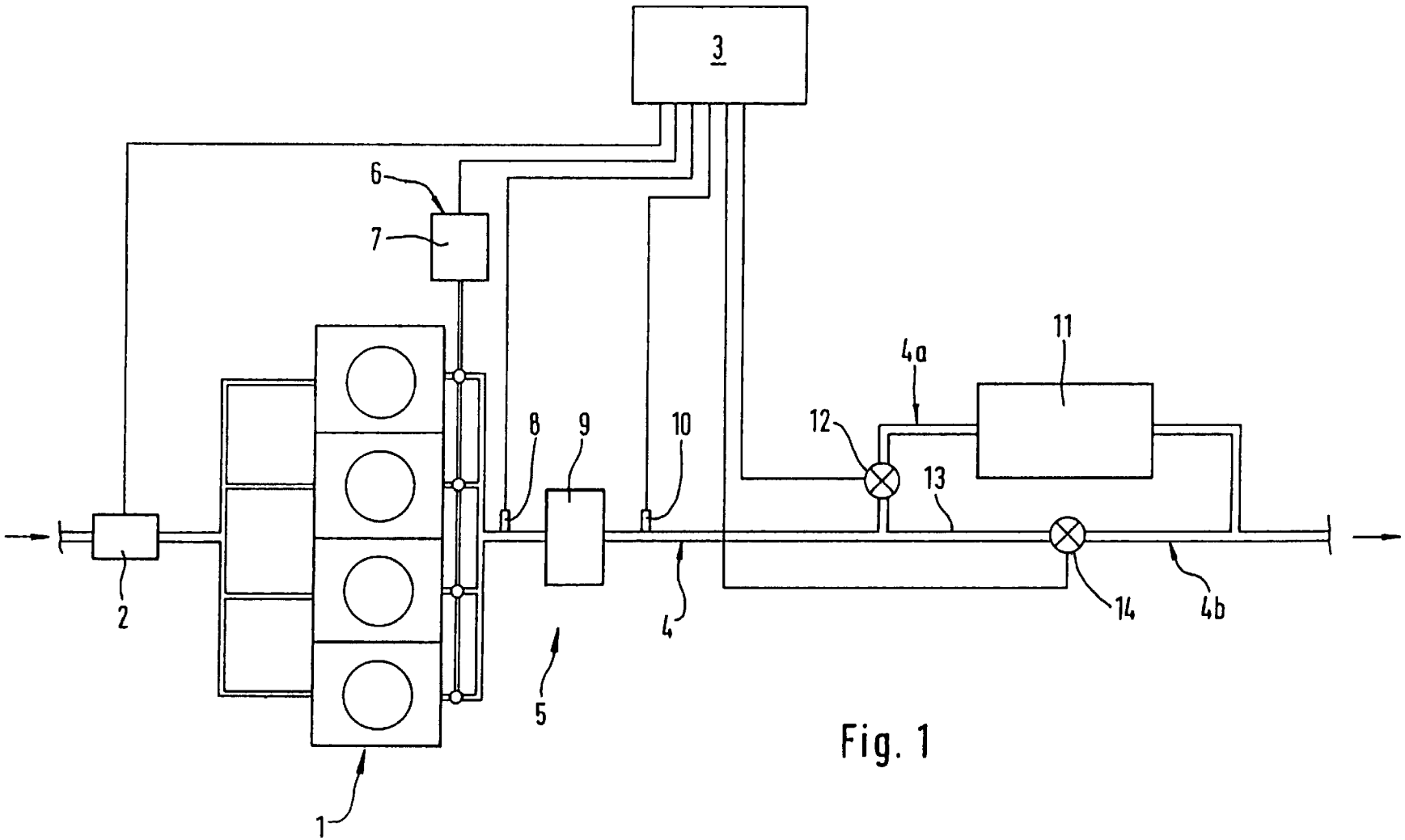
FIG. 1 is a schematic diagram of an internal-combustion engine having an exhaust gas purification system which has a $NO_x$ storage catalyst bypass and is equipped with two closing elements.
Figure 2:
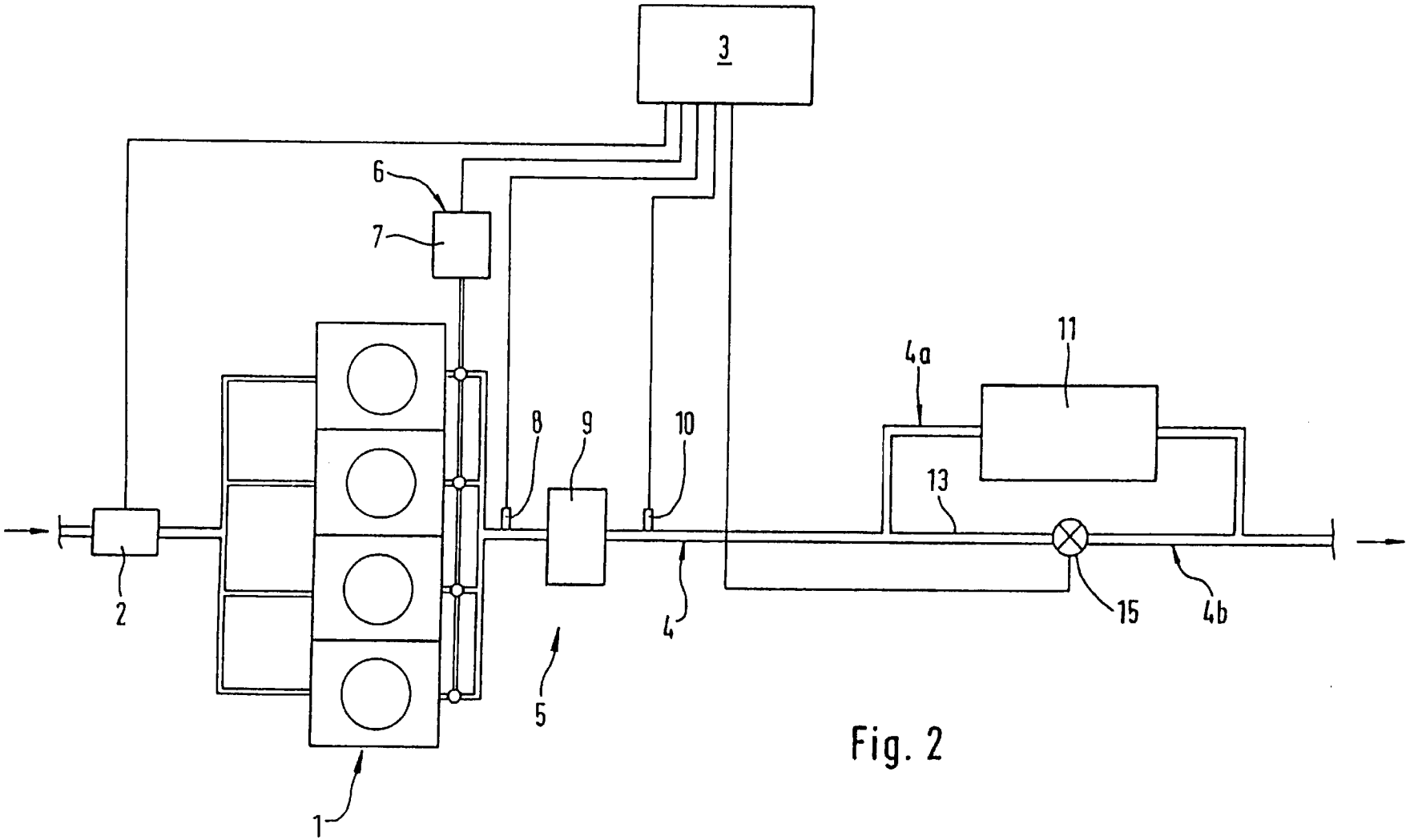
FIG. 2 is a schematic diagram of an internal-combustion engine having an exhaust gas purification system as in FIG. 1, but with only one closing element.
Figure 3:
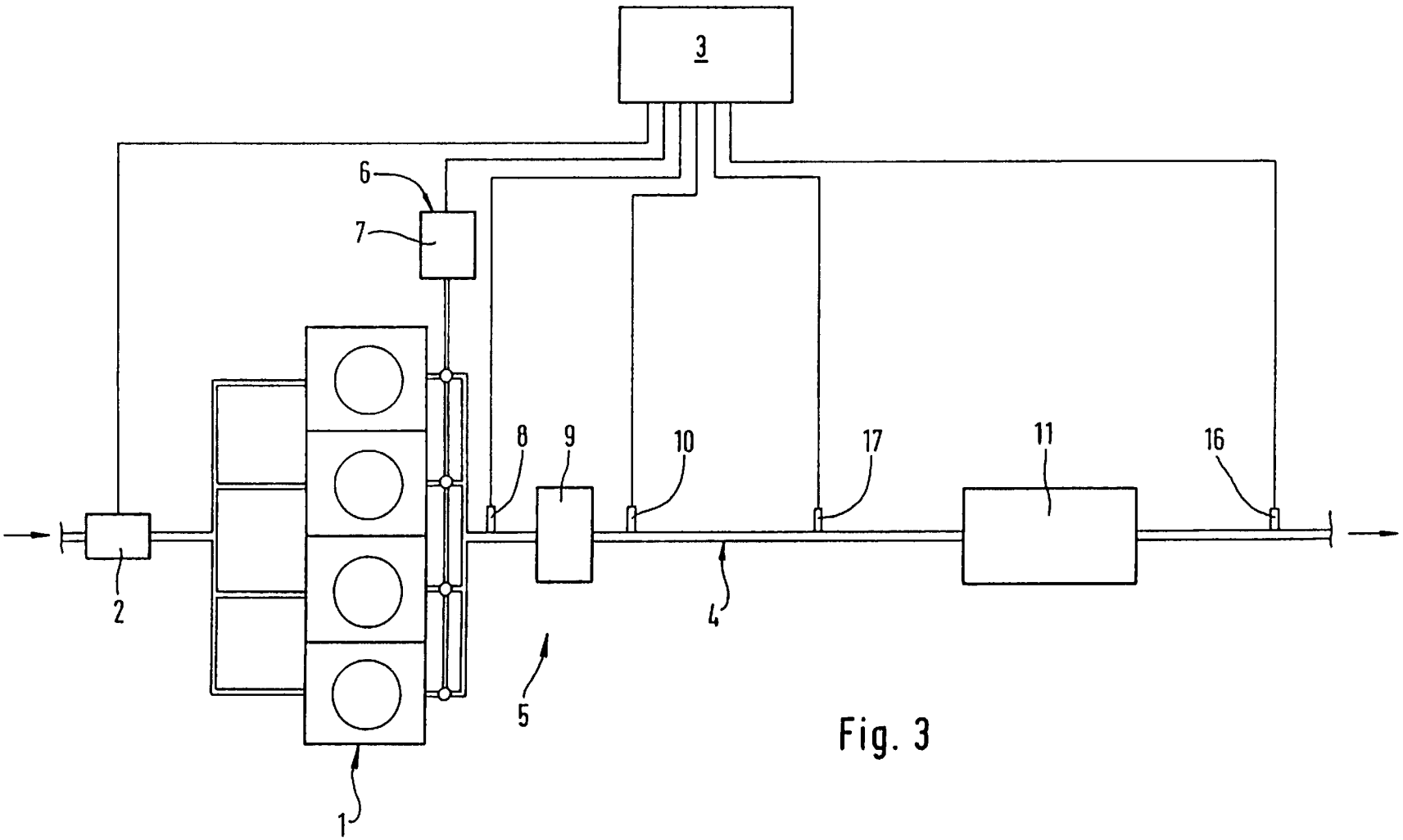
FIG. 3 is a schematic diagram of an internal-combustion engine having an exhaust gas purification system as in FIGS. 1 and 2 but without a bypass.

Corresponding to FIGS. 1 to 3, air is fed by way of an electronically or electrically adjustable throttle valve 2 to an internal-combustion engine 1, which may be a diesel engine or an Otto engine. The throttle valve 2 is connected with an electronic engine control system 3 which has a computer, a memory with data, and corresponding programs.

The exhaust gases formed by the engine 1 during the combustion enter into an exhaust gas line 4 of an exhaust gas purification device 5 of the engine 1. In the illustrated embodiment, a secondary air feed 6 is connected to the exhaust gas line 4 already in the outlet area of the exhaust gases from the internal-combustion engine 1, which secondary air feed 6 can deliver secondary air into the exhaust gas line 4 by means of a secondary air pump 7 controlled by the engine control system 3, for a mixing with the exhaust gases.

Behind the connection points of the secondary air feed 6 on the exhaust gas line 4, a λ-probe 8 is arranged in the exhaust gas line 4 and is connected with the engine control system 3. An $SO_x$ storage catalyst 9, which is preferably constructed as an $SO_x$ trap, is arranged behind the λ-probe 8 in the exhaust gas line 4.

A temperature sensor 10 connected with the engine control system 3 is arranged behind the $SO_x$ storage catalyst 9 in the exhaust gas line 4. The temperature sensor 10 measures a temperature that correlates with the temperature existing in the $SO_x$.

In the embodiment corresponding to FIG. 1, the exhaust gas line 4 forms branches in its further course. An $NO_x$ storage catalyst 11 is arranged in a first branch line 4*a*. A closing element 12 constructed as an exhaust gas flap is arranged in this first branch line 4*a* in front of the $NO_x$ storage catalyst 11, which closing element 12 is connected with the engine control system 3 and can adjusted by it between a passage position and a blocking position.

A second branch line 4*b* constructed behind the branching forms a bypass 13 which bypasses the $NO_x$ storage catalyst 11. In this bypass 13, a closing element 14 is arranged which is also constructed as an exhaust gas flap and which is also connected with the engine control unit 3 and can be adjusted between a passage position and a blocking position.

Behind the $NO_x$ storage catalyst 11, the branch lines 4*a* and 4*b* of the exhaust gas line 4 are combined again to form a point exhaust gas line 4.

The process suggested according to the invention operates as follows:

The engine control system 3 monitors the storage capacity of the $SO_x$ storage catalyst 9 and determines when regeneration of the $SO_x$ storage catalyst is required. In order to determine the current storage capacity of the $SO_x$ storage catalyst 9, sensors (not shown) may be arranged in the $SO_x$ storage catalyst 9 or in the exhaust gas line 4, which detect, for example, a rise of the content of sulfur compounds in the exhaust gas or another parameter correlating with the $SO_x$ storage capacity. Likewise, it is possible to determine the respective current storage capacity of the $SO_x$ storage catalyst 9 by means of characteristic diagrams filed in a corresponding memory, in which, for example, the $SO_x$ storage capacity is a function of the operating period of the internal-combustion engine 1 and of the sulfur content of the exhaust gases coming from the engine 1.

After the engine control system 3 has determined a falling of the $SO_x$ storage capacity to or under a predetermined threshold value, it influences the operating performance of the internal-combustion engine 1 such that it is changed from a lean operation to a rich operation. In this case, a change of the engine power, particularly of the engine torque, which may occur during the change-over between the two operating modes (lean and rich), is compensated, for example, by a corresponding change of the position of the throttle valve 2 so that the driver does not perceive the change between the operating modes.

With the change to the rich engine operation or time-delayed thereto, the secondary air pump 7 is activated so that secondary air is blown into the exhaust gas line 4. In the process, the exhaust gas coming from the engine 1 will mix with the secondary air. Because of the understoichiometric combustion with $\lambda<1$ in the rich operation, the exhaust gases coming from the engine 1 are loaded with reducing agents. By the supply of secondary air, the exhaust gases are also enriched with oxygen.

By means of the $\lambda$-probe 8, the engine control system 3 measures the current $\lambda$-value in front of the $SO_x$ storage catalyst 9, that is, the combustion air ratio of the exhaust gases mixed with the secondary air. In order to set a predetermined $\lambda$-value of the exhaust gases at which an optimal course of the desulfurization of the $SO_x$ storage catalyst 9 can be ensured, the engine control system 3 varies the exhaust gas composition. According to the invention, several possibilities are suggested for this purpose:

(1) at a constant combustion air ratio of the exhaust gases coming from the rich-operated engine, the quantity of fed secondary air is varied by way of a corresponding controlling of the secondary air feed 6 or its secondary air pump 7;

(2) while the quantity of fed secondary air remains constant, by way of the engine control system 3, the combustion air ratio of the exhaust gas coming from the engine 1 can be varied in that the engine control system 3 intervenes in the operation of the engine 1; and (3) the combustion air ratio of the exhaust gases generated by the engine 1 as well as the quantity of the fed secondary air are appropriately influenced by the engine control system 3.

The combustion air ratio endeavored for a desulfurization of the $SO_x$ storage catalyst is preferably selected from the range of $\lambda=0.75$ to $\lambda=0.99$.

The exhaust gases entering the $SO_x$ storage catalyst 9 have a high content of reducing agents (such as CO, $H_2$, HC). In addition, behind the secondary air feed 6, these exhaust gases are enriched with oxygen so that a catalytic combustion can take place in the $SO_x$ storage catalyst 9. During this reaction, the chemical energy stored in the reducing agents is converted by oxidation to thermal energy. The $SO_x$ storage catalyst 9 is heated in this manner and can reach a temperature which is optimal for the desulfurization.

The heating of the $SO_x$ storage catalyst 9 is monitored by means of the temperature sensor 10. This heating of the $SO_x$ storage catalyst 9 can be regulated by varying the combustion air ratio of the exhaust gases fed to the $SO_x$ storage catalyst 9. By means of the temperature sensor 10, the engine control system 3 regulates or sets a temperature in the $SO_x$ storage catalyst 9 which is optimal for the desulfurization, for example, of more than 550° C. In addition, the temperature sensor 10 effectively protects the $SO_x$ storage catalyst 9 and the other components of the exhaust gas purification system 5 from overheating.

During the normal operating phases of the internal-combustion engine 1 or of its exhaust gas purification device 5, in which sulfur compounds are adsorbed and stored in the $SO_x$ storage catalyst 9, the exhaust gas flap 14 of the bypass 13 is closed, while the exhaust gas flap 12 in the branch line 4*a* of the exhaust gas line 4 which contains the $NO_x$ storage catalyst is open. The exhaust gases purified of sulfur compounds therefore flow through the $NO_x$ storage catalyst 11 and are freed of nitrogen oxides ($NO_x$).

During the desulfurization, simultaneously with the activating of the secondary air feed 6 or time-delayed thereto, the exhaust gas flap 12 is closed and the exhaust gas flap 14 is opened so that the exhaust gases, while bypassing the $NO_x$ storage catalyst 11, flow only through the bypass 13. In this manner, it is ensured that sulfur compounds released during the desulfurization of the $SO_x$ storage catalyst 9 cannot be transported by the exhaust gas flow into the $NO_x$ storage catalyst 11. Thus, a sulfate formation in the $NO_x$ storage catalyst 11 and therefore its poisoning or the reduction of its capacity can be effectively prevented.

For avoiding sulfur poisoning of the $NO_x$ storage catalyst 11 during the desulfurization of the $SO_x$ storage catalyst 9, in contrast to the embodiment according to FIG. 1, in the case of another construction of the exhaust gas purification device 5 corresponding to FIG. 2, only one closing element 15 is provided. The closing element 15 is constructed as an exhaust gas flap, is arranged in the bypass 13, and, by way of a connection with the engine control unit 3, can be adjusted by this engine control unit 3 between a passage position and a blocking position. During the normal operation of the internal-combustion engine 1 and of the exhaust gas purification system 5, the exhaust gas flap 15 is in its closed position so that the non-sulfurous exhaust gases flow through the $NO_x$ storage catalyst 11. In contrast, the exhaust flap 15 is switched to passage during the regeneration phase or desulfurization of the $SO_x$ storage catalyst 9. In this embodiment according to FIG. 2, while the exhaust gas flap 15 is open, two flow paths are possible, specifically through the branch line 4*a* and through the branch line 4*b*. The branch line 4 is fluidically constructed in this area such that, when the exhaust gas flap 15 is open, the exhaust gases flow exclusively or at least for the most part through the bypass 13 and no sulfur-containing exhaust gases or only negligibly small fractions flow through the $NO_x$ storage catalyst 11. This is implemented, for example, by increasing the flow resistance in the branch line 4*a,* for example, by means of a throttling point. Because of its construction with only one exhaust gas flap 15, the exhaust gas purification device 5 corresponding to FIG. 2 is less expensive and less susceptible to disturbances than the embodiment corresponding to FIG. 1.

Corresponding to FIG. 3, in another embodiment, protection of the $NO_x$ storage catalyst 11 from sulfur poisoning is achieved during desulfurization also without a bypass. This is achieved in that, in the case of such an exhaust gas purification device 5, before the actual desulfurization of the $SO_x$ storage catalyst 9, the engine control system 3 carries out a regeneration of the $NO_x$ storage catalyst 11.

In the case of the arrangement corresponding to FIG. 3, the whole desulfurization operation takes place as follows:

After the engine control system 3 has determined falling of the $SO_x$ storage capacity of the $SO_x$ storage catalyst 9 to a or below a defined threshold value, as in the embodiments according to FIGS. 1 and 2, the engine control system 3 causes a change-over from a lean operation to a rich operation of the internal-combustion engine 1, but in this case without activating the secondary air feed 6. The internal-combustion engine 1 will then generate exhaust gases with a relatively high reducing agent content which trigger a reducing reaction in the $NO_x$ storage catalyst 11, during which the nitrogen oxides adsorbed in the $NO_x$ storage catalyst 11 are reduced and are released in the form of harmless compounds, such as $N_2$, $CO_2$, $H_2O$. As the result of its regeneration, the $NO_x$ storage catalyst 11 is changed to a reduced condition, in which there are no longer any oxygen-containing species in the $NO_x$ storage catalyst 11.

During this regeneration of the $NO_x$ storage catalyst 11, the exhaust gases of the rich-operated internal-combustion engine, which have reducing effect, also flow through the $SO_x$ storage catalyst 9 so that some reduction can take place also in the $SO_x$ storage catalyst 9, at which, in addition to the sulfur oxide compounds ($SO_x$), oxygen-containing compounds are released.

The end of the regeneration operation for the $NO_x$ storage catalyst 11 is determined by the engine control system 3. The regeneration process takes place, for example, by means of parameters stored in characteristic diagrams or by means of an additional sensor 16 arranged in the exhaust gas line 4 behind the $NO_x$ storage catalyst 11. This sensor 16 is connected with the engine control system 3 and, corresponding to a preferred embodiment, can be constructed as a λ-probe. The end of the regeneration phase can be detected by the sensor 16, for example, because of the fact that the reducing agents contained in the exhaust gas increasingly flow unchanged through the $NO_x$ storage catalyst 11.

After the conclusion of the regeneration phase of the $NO_x$ storage catalyst 11, the actual desulfurization of the $SO_x$ storage catalyst 9 begins. By means of the secondary air feed 6, secondary air is introduced into the exhaust gases coming from the engine 1. By means of the combustion air ratio in front of the $SO_x$ storage catalyst 9, the optimal conditions for the desulfurization are set and regulated by the engine control system 3. In this case, it is definitely possible that, for the regeneration of the $NO_x$ storage catalyst 11, a rich operation is set which has a different λ value than that for the desulfurization of the $SO_x$ storage catalyst 9.

The sulfur compounds released during the desulfurization are guided by the exhaust gas flow to the $NO_x$ storage catalyst 11. However, since this $NO_x$ storage catalyst 11 is in a reduced condition, the sulfur compounds contained in the exhaust gas cannot be adsorbed and stored by its adsorber material so that the sulfur compounds flow unchanged through the $NO_x$ storage catalyst 11. By means of this skillful regulating process suggested according to the invention, sulfurization or sulfur poisoning of the $NO_x$ storage catalyst can be effectively avoided during the desulfurization of the $SO_x$ storage catalyst 9.

In contrast to the embodiments corresponding to FIGS. 1 and 2 described earlier, an exhaust purification device 5 corresponding to FIG. 3 has no exhaust gas flaps, so that the overall construction of the exhaust gas purification system 5 is much more robust and less susceptible to disturbances and is easy to service and altogether reasonable in price.

In all illustrated embodiments, the end of the desulfurization of the $SO_x$ storage catalyst 9 is determined by the engine control system 3, for example, by means of parameters stored in characteristic diagrams. In addition, or as an alternative, corresponding to FIG. 3, another sensor 17 may be arranged between the $SO_x$ storage catalyst 9 and the $NO_x$ storage catalyst 11 in the exhaust gas line 4, particularly in the case of the examples according to FIGS. 1 and 2, in front of the bypass 13. Sensor 17 is connected with the engine control system 3. This sensor 17 can detect, for example, a decrease of released sulfur compounds in the exhaust gases or, corresponding to another embodiment, may be constructed as a λ probe and monitor the combustion air ratio of the exhaust gases behind the $SO_x$ storage catalyst 9.

The foregoing disclosure has been set forth merely to illustrate the invention and is not intended to be limiting. Since modifications of the disclosed embodiments incorporating the spirit and substance of the invention may occur to persons skilled in the art, the invention should be construed to include everything within the scope of the appended claims and equivalents thereof.

What is claimed is:

1. A process for purifying exhaust gases of an internal-combustion engine having an engine control system that permits a change between a lean operation and a rich operation, and having an exhaust gas purification system, wherein a λ-probe, an $SO_x$ storage catalyst and an $NO_x$ storage catalyst are successively arranged in an exhaust gas line behind the engine, said process comprising:

measuring a $SO_x$ storage capacity of the $SO_x$ storage catalyst;

starting desulfurization of the $SO_x$ storage catalyst when the $SO_x$ storage capacity decreases below a preset value by changing the engine from lean operation to rich operation;

feeding secondary air into the exhaust gas line in front of the λ-probe;

detecting a combustion air ratio of exhaust gases from the engine mixed with the secondary air by the λ-probe;

setting the combustion air ratio to a predetermined value;

measuring a temperature existing in the $SO_x$ storage catalyst;

setting the temperature existing in the $SO_x$ storage catalyst to a predetermined value; and when a predetermined threshold value for the $SO_x$ storage capacity is reached, terminating the desulfurization by changing the engine from rich operation to lean operation.

2. A process according to claim 1, wherein said measuring of the $SO_x$ storage capacity is by means of a sensor operatively connected with the engine control system.

3. A process according to claim 1, wherein said feeding of the secondary air is by means of a controllable secondary air feed.

4. A process according to claim 1, further comprising varying at least one of the secondary air and a combustion air ratio of the exhaust gases from the engine during desulfurization, thereby obtaining the predetermined value for the combustion air ratio of the exhaust gases mixed with the secondary air and the predetermined value for the temperature of the $SO_x$ storage catalyst.

5. A process according to claim 1, further comprising, activating a bypass during desulfurization for bypassing the $NO_x$ storage catalyst in the exhaust gas line.

6. A process according to claim 5, further comprising, guiding the exhaust gases through the bypass and blocking the exhaust gases from the $NO_x$ storage catalyst during desulfurization and;

guiding the exhaust gases through the $NO_x$ storage catalyst and blocking the exhaust gases from the bypass after desulfurization.

7. A process according to claim 6, wherein said guiding and blocking during and after desulfurization is by a switch in a forking of the exhaust gas line leading to the $NO_x$ storage catalyst and the bypass.

8. A process according to claim 6, wherein said guiding and blocking is by a first closing element in the inflow to the $NO_x$ storage catalyst and a second closing element in the bypass, the closing elements alternately switching between guiding and blocking.

9. A process according to claim 5, wherein a closing element is in the bypass, and the bypass and the $NO_x$ storage catalyst in the exhaust gas line are designed such that, when the closing element is switched open, the exhaust gases only flow through the bypass.

10. A process according to claim 1, further comprising, after changing from lean to rich operation, regenerating the $NO_x$ storage catalyst; and upon reaching a predetermined threshold value for regeneration, feeding the secondary air into the exhaust gas line.

11. A process according to claim 10, further comprising detecting a degree of the regeneration of the $NO_x$ storage catalyst by a sensor behind the $NO_x$ storage catalyst in the exhaust gas line.

12. A process according to claim 11, wherein said sensor is a λ-probe.

13. A process according to claim 1, wherein the $SO_x$ storage capacity of the $SO_x$ storage catalyst is determined as a function of an operating period of the engine and of a composition of the exhaust gases coming from the engine.

14. A process according to claim 1, wherein the $SO_x$ storage capacity is measured by a sensor between the $SO_x$ storage catalyst and the $NO_x$ storage catalyst in the exhaust gas line.

15. A process according to claim 14, wherein said sensor is a λ-probe.

16. A process according to claim 1, wherein the predetermined value of the combustion air ratio of the exhaust gases mixed with the secondary air is from $\lambda=0.75$ to 0.99.

17. A process according to claim 1, wherein the predetermined value for the temperature in the $SO_x$ storage catalyst is more than 550° C.

18. A process according to claim 1, further comprising, during changing between the lean operation and the rich operation, varying an air feeding to the engine by means of a controllable throttle valve, thereby generating a constant engine torque or a constant engine power.

19. A system for purifying exhaust gases of an internal-combustion engine, comprising:

an engine control system that permits a change between a lean operation and a rich operation;

an exhaust gas purification system;

a λ-probe;

an $SO_x$ storage catalyst;

an $NO_x$ storage catalyst, wherein said λ-probe, $SO_x$ storage catalyst, and an $NO_x$ storage catalyst are successively arranged in an exhaust gas line behind the engine;

means for measuring a $SO_x$ storage capacity of the $SO_x$ storage catalyst;

means for feeding secondary air into the exhaust gas line in front of the λ-probe;

means for detecting a combustion air ratio of exhaust gases from the engine mixed with the secondary air by the λ-probe; and means for measuring a temperature existing in the $SO_x$ storage catalyst.

* * * * *